US006755385B2

(12) United States Patent
Lancelot, III et al.

(10) Patent No.: US 6,755,385 B2
(45) **Date of Patent: *Jun. 29, 2004**

(54) CONCRETE VOID FORMER AND COOPERATING COVER

(75) Inventors: Harry B. Lancelot, III, Centerville, OH (US); Thomas E. Lannom, Dayton, OH (US); Sidney E. Francies, III, Springboro, OH (US)

(73) Assignee: Dayton Superior Corporation, Dayton, OH (US)

( * ) Notice: Subject to any disclaimer, the term of this patent is extended or adjusted under 35 U.S.C. 154(b) by 64 days.

This patent is subject to a terminal disclaimer.

(21) Appl. No.: 10/095,736

(22) Filed: Mar. 12, 2002

(65) Prior Publication Data

US 2002/0096619 A1 Jul. 25, 2002

Related U.S. Application Data

(63) Continuation of application No. 09/544,746, filed on Apr. 7, 2000, now Pat. No. 6,460,824.

(60) Provisional application No. 60/128,349, filed on Apr. 8, 1999.

(51) Int. Cl.[7] ..... E04G 15/04

(52) U.S. Cl. ..... 249/91; 249/97; 249/183

(58) Field of Search ..... 249/35, 91, 96, 249/97, 142, 170, 183; 52/125.5, 704, 707

(56) References Cited

U.S. PATENT DOCUMENTS

| | | | | |
|---|---|---|---|---|
| 4,017,115 A | | 4/1977 | Holt et al. | 294/89 |
| 4,296,909 A | | 10/1981 | Haeussler | 249/94 |
| 4,325,575 A | | 4/1982 | Holt et al. | 294/89 |
| RE31,131 E | | 1/1983 | Torbet et al. | 294/89 |
| 4,367,892 A | | 1/1983 | Holt | 294/89 |
| 4,386,486 A | | 6/1983 | Holt et al. | 52/125.5 |
| 4,437,642 A | | 3/1984 | Holt | 249/175 |
| 4,468,149 A | | 8/1984 | Kelly et al. | 403/316 |
| 4,580,378 A | | 4/1986 | Kelly et al. | 52/125.5 |
| 4,627,198 A | | 12/1986 | Francies, III | 52/125.5 |
| 4,671,554 A | * | 6/1987 | Lancelot | 294/89 |
| 4,807,843 A | | 2/1989 | Courtois et al. | 249/61 |
| 4,821,994 A | | 4/1989 | Fricker | 249/91 |
| 4,823,527 A | * | 4/1989 | Harbeke | 52/220.8 |
| 4,888,922 A | | 12/1989 | Lancelot | 52/124.2 |
| 4,930,269 A | | 6/1990 | Kelly et al. | 52/125.5 |
| 5,014,473 A | | 5/1991 | Kelly et al. | 52/125.5 |
| 5,094,047 A | | 3/1992 | Kelly et al. | 52/125.5 |
| 5,226,265 A | | 7/1993 | Kelly et al. | 52/125.6 |
| 5,535,979 A | | 7/1996 | Ellis-Callow | 249/94 |
| 5,596,846 A | | 1/1997 | Kelly | 52/125.2 |
| 5,623,804 A | | 4/1997 | Kelly et al. | 52/704 |
| 5,625,993 A | | 5/1997 | Kelly | 52/704 |
| 5,651,911 A | | 7/1997 | Pennypacker | 249/94 |
| D389,251 S | | 1/1998 | Kelly | D25/133 |

FOREIGN PATENT DOCUMENTS

| | | | |
|---|---|---|---|
| EP | 0779399 | 6/1996 | E04B/1/41 |
| EP | 0854244 | 7/1998 | E04B/1/41 |
| WO | 9713939 | 4/1997 | E04G/21/16 |

OTHER PUBLICATIONS

US 5,546,727, 8/1996, Kelly et al. (withdrawn)

* cited by examiner

*Primary Examiner*—James P. Mackey
*Assistant Examiner*—Donald Heckenberg
(74) *Attorney, Agent, or Firm*—Wood, Herron & Evans, LLP

(57) ABSTRACT

An anchor positioning assembly for use in casting a concrete panel. The anchor positioning assembly includes a void former, a cooperating cover and an anchor. The assembly may further include an adaptor insert for receiving anchors of variable shapes and sizes. The void former includes a body having first and second portions pivotally connected by a pair of hinge webs. A peripheral lip extends outwardly from the periphery of the void former. A cover includes a top plate having a reentrant edge defining a locking groove for releasably engaging the peripheral lip of the void former, thereby providing a seal between the void former and the cover. The cover includes a plurality of mounting apertures to facilitate securing of the cover to concrete formwork.

11 Claims, 6 Drawing Sheets

CONCRETE VOID FORMER AND COOPERATING COVER

CROSS-REFERENCE TO RELATED APPLICATION

The present application is a continuation of U.S. Ser. No. 09/544,746, filed Apr. 7, 2000, now U.S. Pat. No. 6,460,824, which claims the filing benefit of U.S. Serial No. 60/128, 349, filed Apr. 8, 1999, the disclosures of which are hereby incorporated by reference herein in their entirety.

BACKGROUND OF THE INVENTION

1. Field of the Invention

The present invention relates to the fabrication and handling of precast concrete panels. More particularly, the invention is directed to an anchor positioning assembly for forming a recess in a face of a concrete panel and for the simultaneous positioning of an anchor within the recess.

2. Description of the Prior Art

Precast concrete construction includes the prefabrication of concrete wall panels. It is well known in the art to use recessed anchors in such concrete panels wherein external hoisting devices are engagable with the anchors for moving the panels to desired locations. Each panel is typically carried by a mobile crane to its final position where it is temporarily braced until tied into a roof and floor system to become an integral part of the completed structure.

The anchors are preferably recessed from an outer surface of the concrete panel thereby eliminating the need for a subsequent anchor cutting operation after the concrete panel has been hoisted to its intended location. Various devices, typically called "void formers", have been proposed for the positioning of anchors within the recesses of concrete panels. Many of these void formers include open interior portions facing outwardly away from the concrete panel to facilitate the insertion of tools therein for removing the void former from the hardened concrete panel while leaving the anchor embedded within the concrete panel. However, during the formation of the precast concrete panel, the open interior portions of the void former may be filled with concrete so that tools may not be effectively inserted, thereby making it difficult to remove the void former from the concrete panel.

While covers cooperating with the top of the void formers have been proposed, an inadequate seal is often formed between the void former and the cover such that concrete still flows into the open interior portions of the void former. Further, conventional covers must be secured to the void formers prior to mounting to the formwork used to define the mold for forming the concrete panel. As such, the entire anchor positioning assembly including the cover, the void former and the anchor must be mounted to the formwork at the same time. This is often a difficult and time consuming task.

Finally, traditional void formers are adapted for use with only an anchor of a particular design, i.e. size and shape. Therefore, different void formers are often required depending upon the particular dimensions of the anchor to be embedded within the concrete panel.

Accordingly, there is a need for a void former and cooperating cover having a structure which substantially prevents the flow of concrete into the interior of the void former. Further, there is a need for such a cover which may be directly mounted to the concrete panel formwork wherein the void former may be simply and easily secured to the cover fixed to the formwork. Finally, there is a need for a void former that is adaptable for receiving anchors of variable sizes and shapes.

SUMMARY OF THE INVENTION

The present invention provides an anchor positioning assembly for use in the casting of a concrete panel. More particularly, the anchor positioning assembly includes a void former which secures an anchor during concrete casting and which is removed from the anchor after casting, thereby leaving a recess within a face of the concrete panel and containing a portion of the anchor.

The anchor positioning assembly includes the void former, a cooperating cover and the anchor. The assembly may further include an adaptor insert for receiving anchors of variable shapes and sizes.

The void former includes a body having first and second portions pivotally connected by a pair of hinge webs and symmetrically disposed on opposite sides of a center plane. The first and second portions each include opposing tapered side walls, an arcuate end wall connecting the opposing side walls, and a substantially open chamber defined by the opposing side walls and the end wall. The opposing side walls connect an upper surface of the void former to an arcuate lower surface of the void former as defined by the end walls.

An anchor placement channel extends upwardly from the lower surface of the void former towards the upper surface. The anchor placement channel is defined by a pair of inwardly facing channel walls and the hinge webs. Each inwardly facing channel wall includes a securing lug wherein the pair of lugs face each other on opposite sides of the center plane.

Each of the first and second portions includes a cylindrical rib defining a receiving bore extending upwardly from the arcuate end wall within one of the chambers. Strengthening ribs extend outwardly from each cylindrical rib to interconnect the arcuate lower surface, side walls and inwardly facing channel wall of each of the first and second portions of the body. The cylindrical and strengthening ribs provide additional strength and structural stability to the void former. A locating recess is centrally disposed within the void former and extends downwardly from the upper surface.

A peripheral edge is defined by the opposing side walls and the end walls of the first and second portions of the void former. A first locking member, preferably a peripheral lip, is supported by the opposing side walls and the end walls adjacent the upper surface. The peripheral lip extends proximate at least a portion of the peripheral edge of the void former intermediate a plurality of mounting tabs which are formed integral with the opposing side walls. The mounting tabs include apertures to facilitate fixing of the void former to conventional formwork using nails or similar fasteners.

The cover cooperates with and sealingly engages the void former. The cover includes a top plate having a peripheral edge, and a pair of cylindrical pegs extending downwardly from the top plate. The cylindrical pegs are slidably receivable within the receiving bores of the void former. A locating wall arranged in a rectangular configuration similarly extends downwardly from the top plate and is slidably receivable within the locating recess of the void former.

A second locking member preferably comprises a reentrant edge supported by the top plate and positioned proximate at least a portion of the peripheral edge of the cover. The reentrant edge defines a locking groove which is releasably and lockingly engagable with the lip of the void former.

The locking groove extends substantially around the cover proximate the peripheral edge and is interspaced by mounting recesses in which the mounting tabs of the void former are receivable. The mounting recesses have apertures which are coaxially aligned with the apertures of the mounting tabs of the void former such that a single nail or fastener may be passed through the coaxially aligned apertures for fixing the anchor positioning assembly to the formwork and provide a seal between the mounting recess and mounting tab. A plurality of cover mounting apertures are likewise provided proximate the periphery of the cover for mounting the cover to the formwork independently of the void former.

The anchor is received within the anchor placement channel of the void former. A pair of recessed portions are provided within opposing sides of the anchor. The recessed portions preferably interconnect to form an aperture extending through the anchor. The securing lugs of the void former are receivable within the aperture of the anchor for releaseably locking the anchor within the void former.

The adaptor insert may be received within the anchor placement channel for positioning anchors of various shapes and sizes within the void former. The adapter insert is preferably U-shaped and includes first and second legs connected by a bridge. The adapter insert is releaseably securable within the anchor placement channel and provides an inner surface conforming substantially to the upper end of an anchor positioned within the void former.

Therefore, it is an object of the present invention to provide an anchor positioning assembly for forming a recess within a concrete panel and for simultaneously positioning an anchor within the recess.

It is a further object of the present invention to provide a void former which is inexpensive and disposable.

It is another object of the present invention to provide a cover which may be utilized with a wide variety of different void formers.

It is vet another object of the present invention to provide a void former cover having a structure facilitating independent mounting to preexisting formwork.

It is a further object of the present invention to provide an anchor positioning assembly including a cooperating cover and void former where the void former may be snap-locked into releaseable engagement with the cover.

It is still yet another object of the present invention to provide such an anchor positioning assembly which facilitates improved sealing engagement between the void former and the cover.

It is a further object of the present invention to provide a void former having a structure enabling it to accept anchors having a wide variety of shapes and sizes.

Other objects and advantages of the invention will be apparent from the following description, the accompanying drawings and the appended claims.

DETAILED DESCRIPTION OF THE PREFERRED EMBODIMENT

Figure 1:
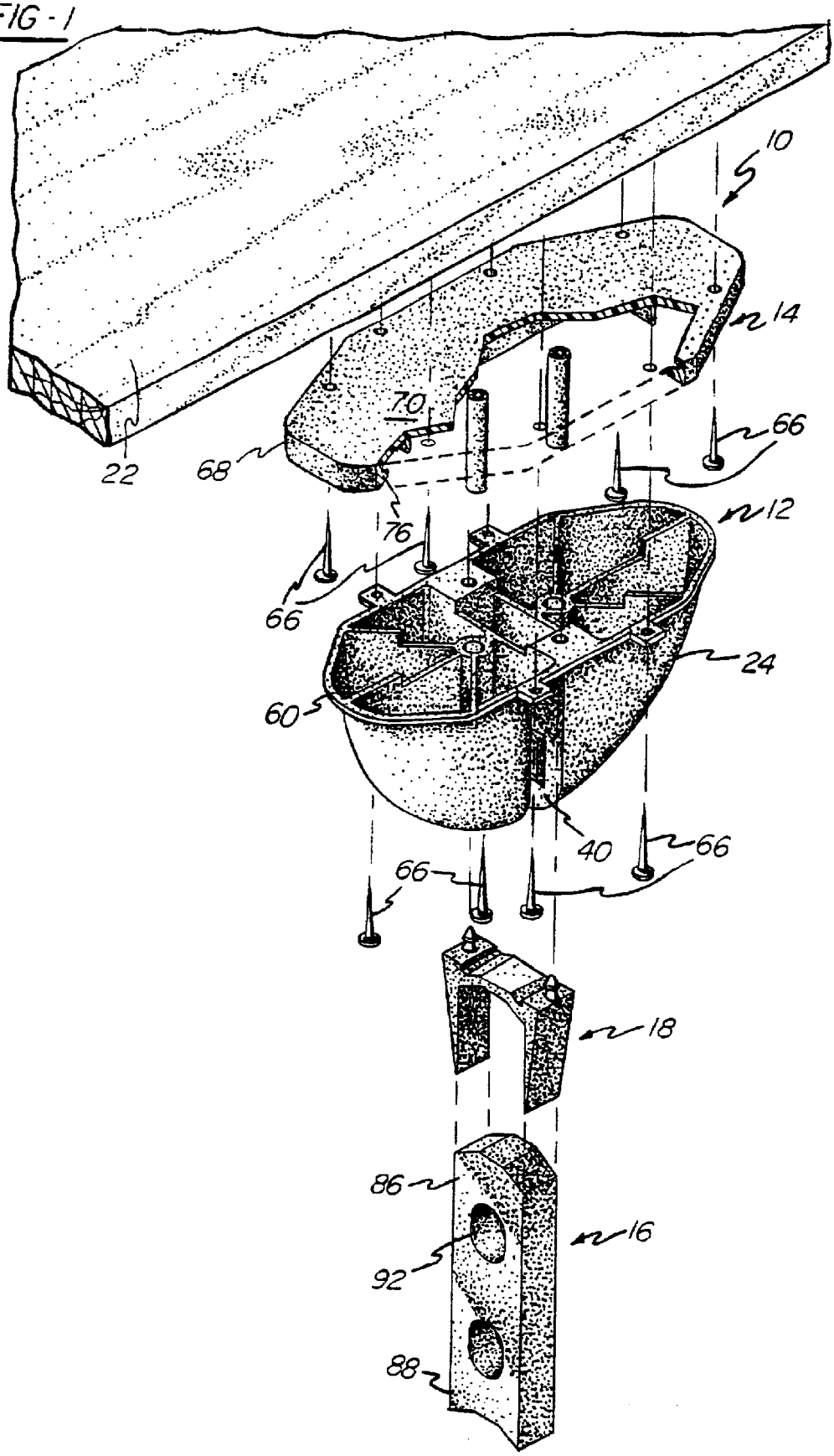
FIG. 1 is an exploded perspective view of the anchor positioning assembly of the present invention, with a partial cut-away of the cover.
Figure 2:
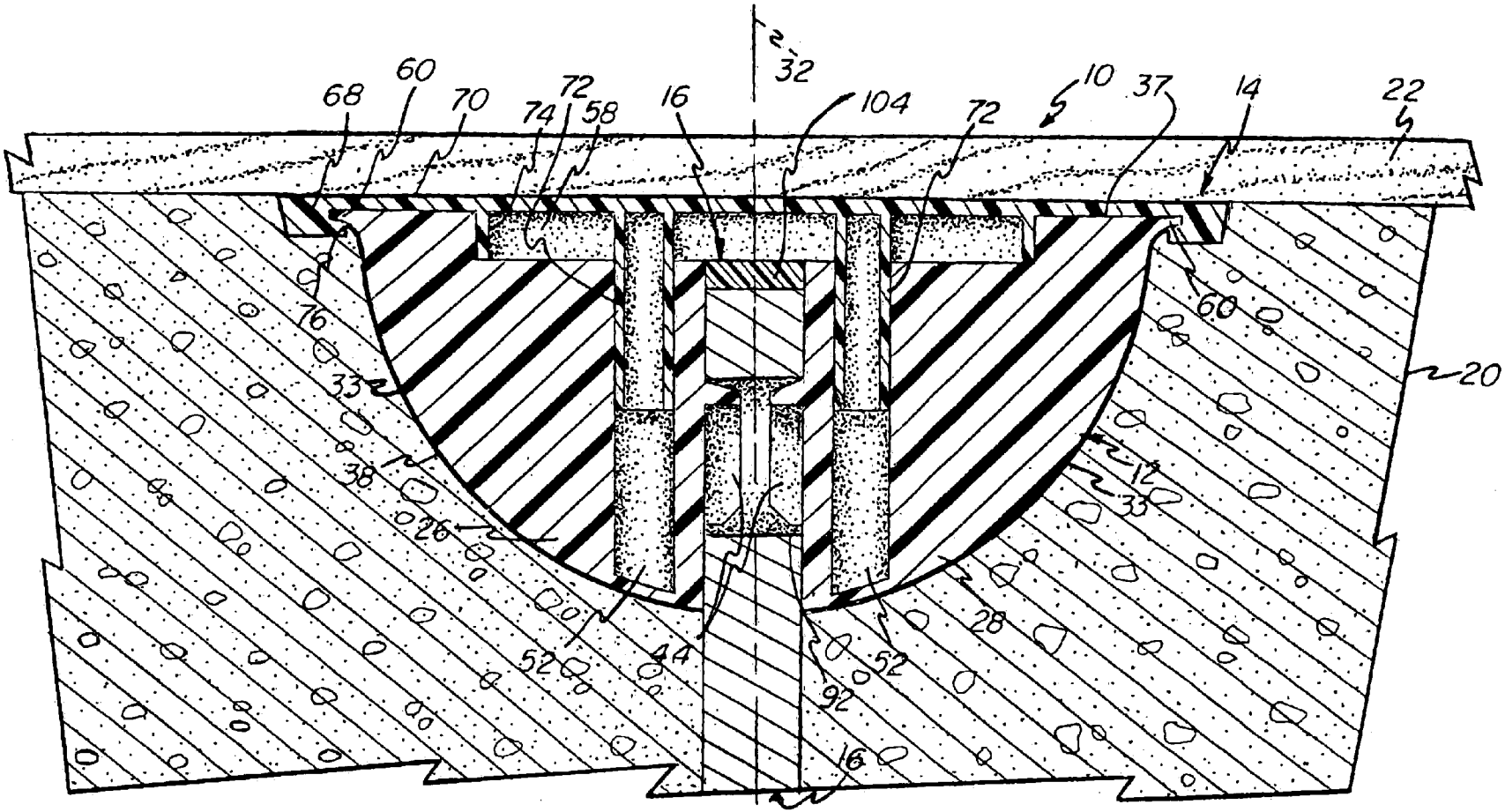
FIG. 2 is a cross-sectional view of the anchor positioning assembly of FIG. 1 embedded within a concrete panel.

Referring initially to FIGS. 1 and 2 of the drawings, the anchor positioning assembly 10 of the present invention is illustrated as including a void former 12 and a cooperating cover 14 wherein an anchor 16 is received within the void former 12. As explained hereinbelow, an adaptor insert 18 may be utilized to facilitate the receipt of anchors 16 having variable shapes and sizes within the void former 12.

As illustrated in FIG. 2, the anchor positioning assembly 10 of the present invention is illustrated as locating the anchor 16 within a concrete panel 20. The concrete panel 20 is generally cast at the job site within conventional formwork 22, typically wood planks or boards. The anchor positioning assembly 10 is mounted flush with the formwork 22 such that concrete is cast around the void former 12.

A concrete panel 20 is used for illustrative purposes in describing the anchor positioning assembly 10 of the present invention. However, such an application in no way limits the scope of the present invention and the anchor positioning assembly 10 may find equal applicability with any of a wide variety of precast concrete elements.

Referring now to FIGS. 1–4, the void former 12 includes a substantially hollow, shell-like body 24. The body 24 includes first and second portions 26 and 28 pivotally connected by a pair of hinge webs 30. The hinge webs 30 are centrally disposed along a center plane 32 such that the first and second portions 26 and 28 are symmetrically positioned on opposite sides of the center plane 32.

Figure 3:
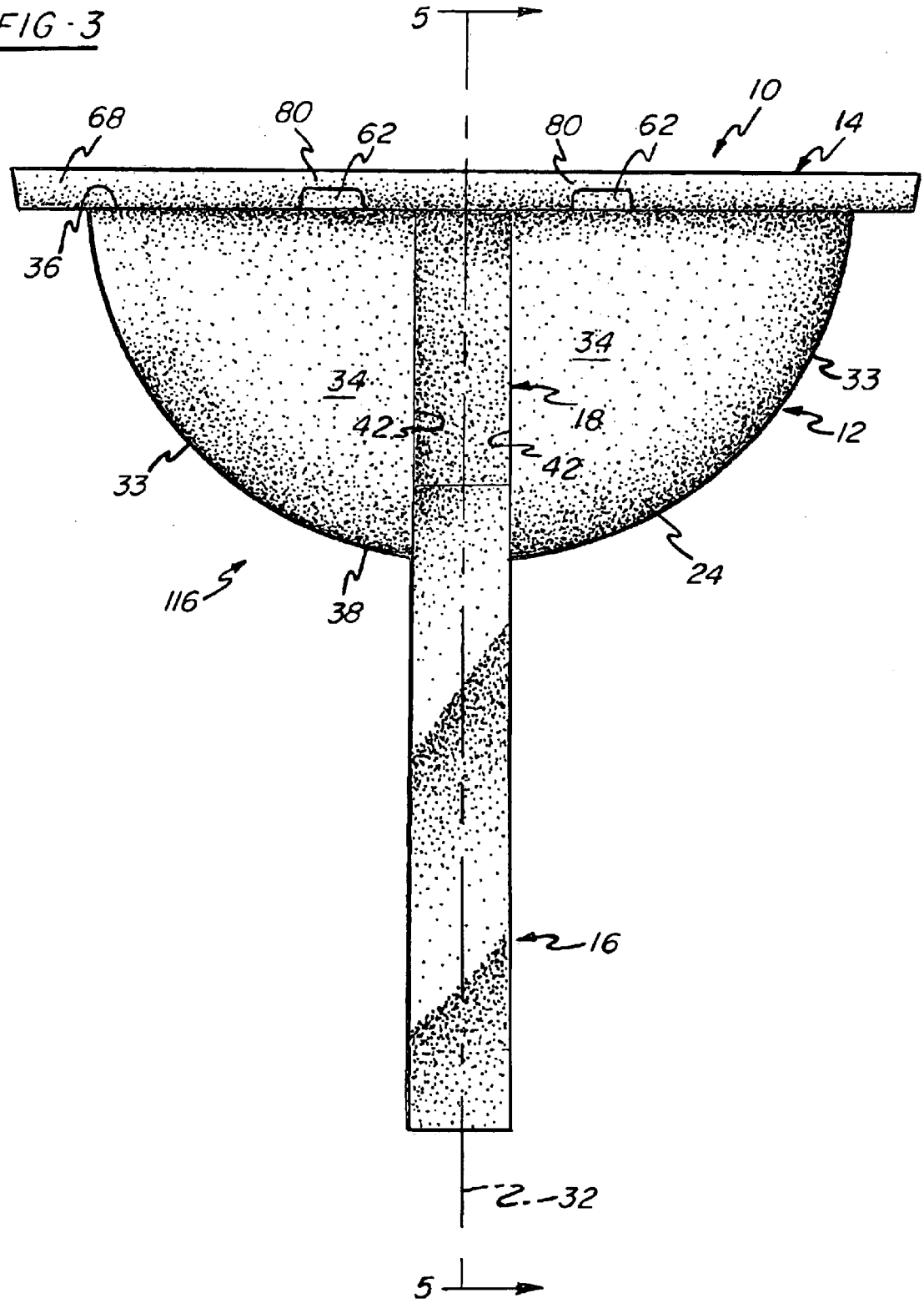
FIG. 3 is a side elevational view of the anchor positioning assembly of FIG. 1.
Figure 4:
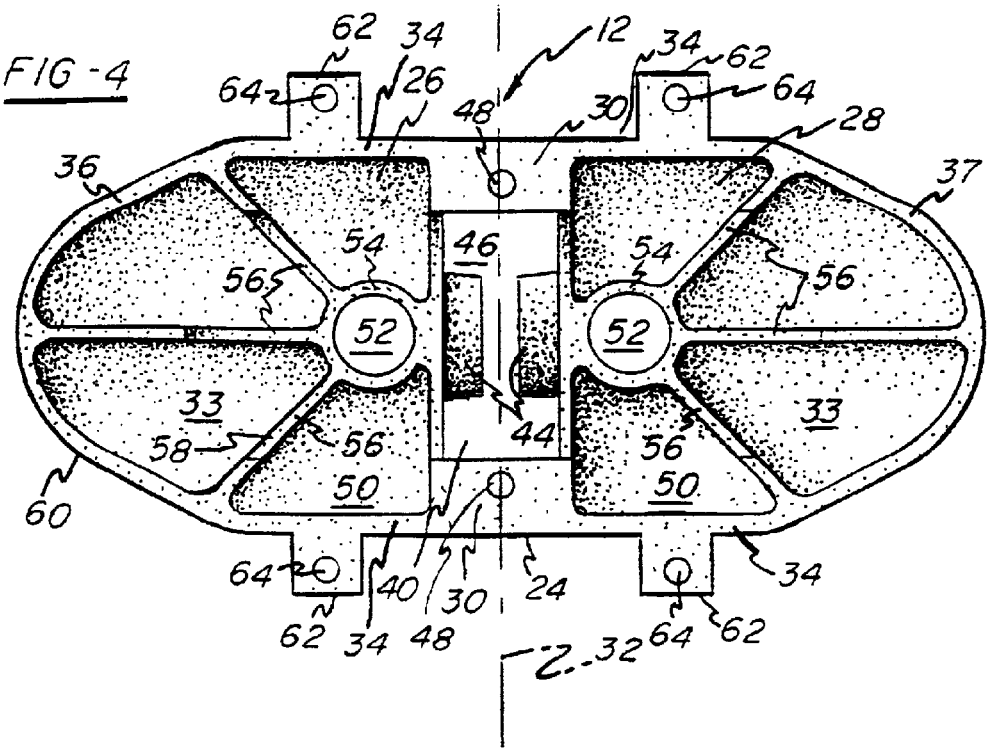
FIG. 4 is a top plan view of the void former of FIG. 1.

The first and second portions 26 and 28 of the void former 12 each include an arcuate end wall 33 connecting opposing tapered side walls 34. An upper surface 36 and a peripheral edge 37 are defined by the opposing side walls 34 and the end walls 33 (FIGS. 2 and 4), while an arcuate lower surface 38 is defined by the end walls 33 (FIG. 3). An anchor placement channel 40 is centrally positioned about the center plane 32 and is defined by inwardly facing channel walls 42 and the hinge webs 30. The anchor placement channel 40 extends upwardly from the lower surface 38 towards the upper surface 36. A securing lug 44 extends from each inwardly facing channel wall 42 towards the center plane 32.

The hinge webs 30 are relatively thin and separated by a rectangular opening 46 such that the first and second portions 26 and 28 may pivot relative to each other. As may be appreciated, pivoting movement of the first and second portions 26 and 28 results in movement of the inwardly facing channel walls 42 and securing lugs 44 such that the anchor placement channel 40 may be opened or closed. A pair of through apertures 48 are preferably formed within the hinge webs 30 for releasably engaging the adaptor insert 18 as described in greater detail below.

Each of the first and second portions 26 and 28 of the void former 12 are substantially hollow, thereby defining a substantially open chamber 50 between the respective side walls 34, end walls 33 and channel walls 42. Each of the first and second portions 26 and 28 include a receiving bore 52 extending upwardly from the arcuate end wall 33 and defined by a cylindrical rib 54. A plurality of strengthening ribs 56 extend outwardly from each receiving bore 52 thereby interconnecting each of the cylindrical ribs 54 to the side walls 34, lower surface 38 and one of the inwardly facing walls 42.

Figure 5:
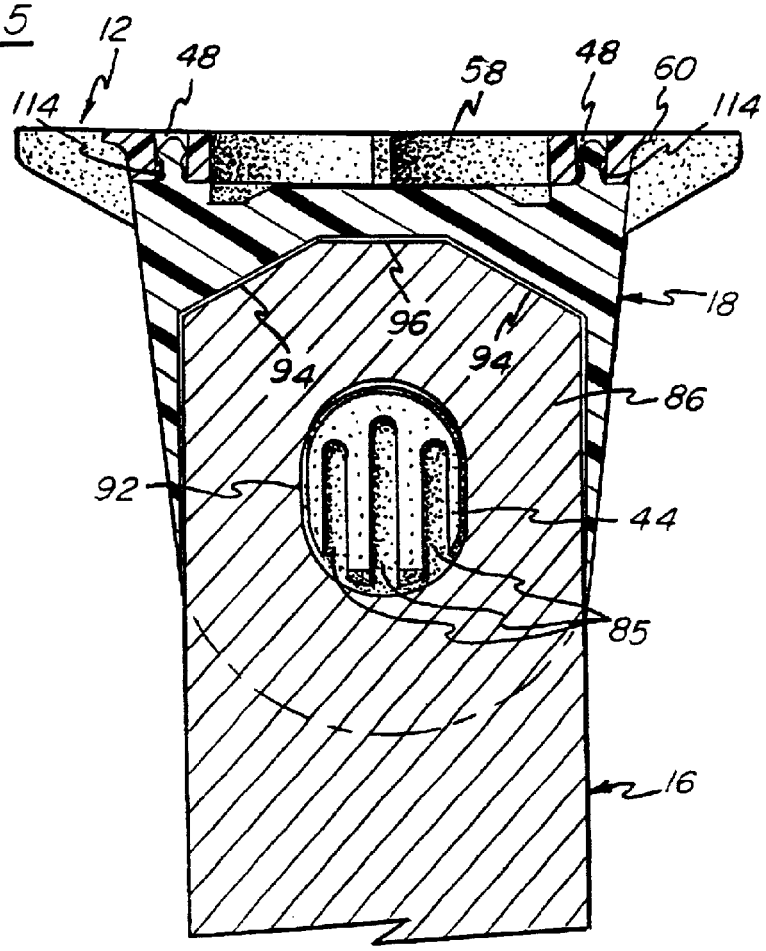
FIG. 5 is a cross-sectional view taken along line 5—5 of FIG. 3.
Figure 6:
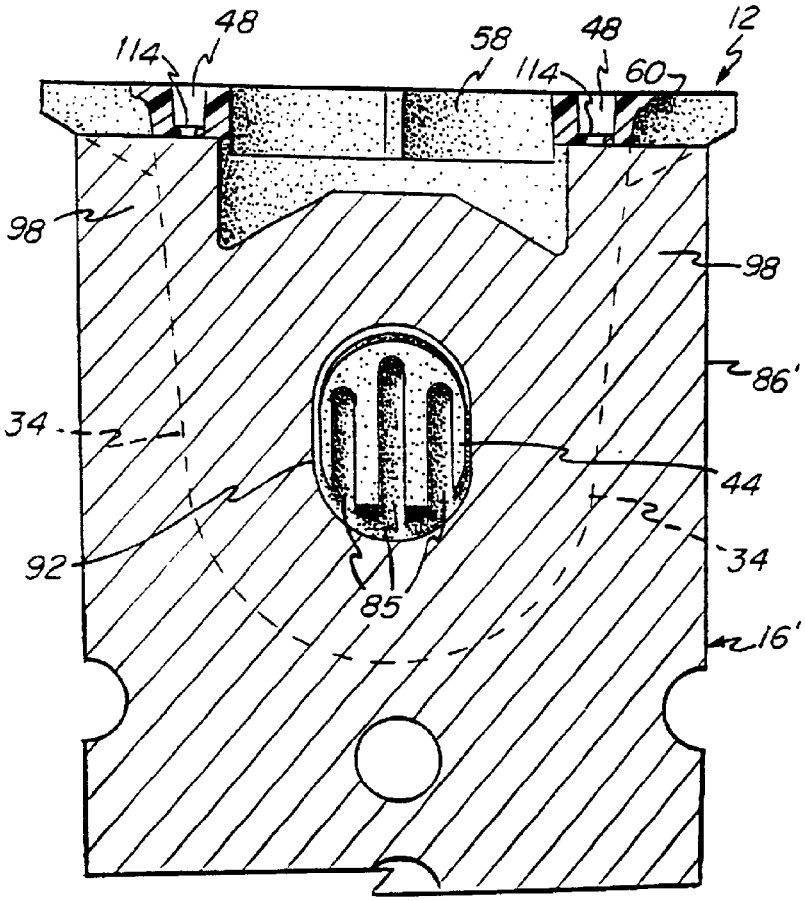
FIG. 6 is a cross-sectional view of an alternative embodiment of the anchor positioning assembly of the present invention.

A rectangular locating recess 58 is formed within the cylindrical ribs 54 and the strengthening ribs 56 and extends downwardly relative to the upper surface 36 of the void former (FIGS. 2, 5 and 6). The locating recess 58 is preferably centrally disposed within the void former 12.

A first locking member, preferably a peripheral lip 60, or feather edge, is positioned adjacent the upper surface 36 of the void former 12. The peripheral lip 60 extends substantially continuously proximate the peripheral edge 37 of the void former 12 intermediate a plurality of mounting tabs 62. The mounting tabs 62 extend outwardly from the side walls 34 of the void former and include apertures 64 for facilitating passage therethrough by fasteners, preferably nails 66 (FIG. 1), for fixing the void former 12 to the concrete formwork 22.

Figure 7:
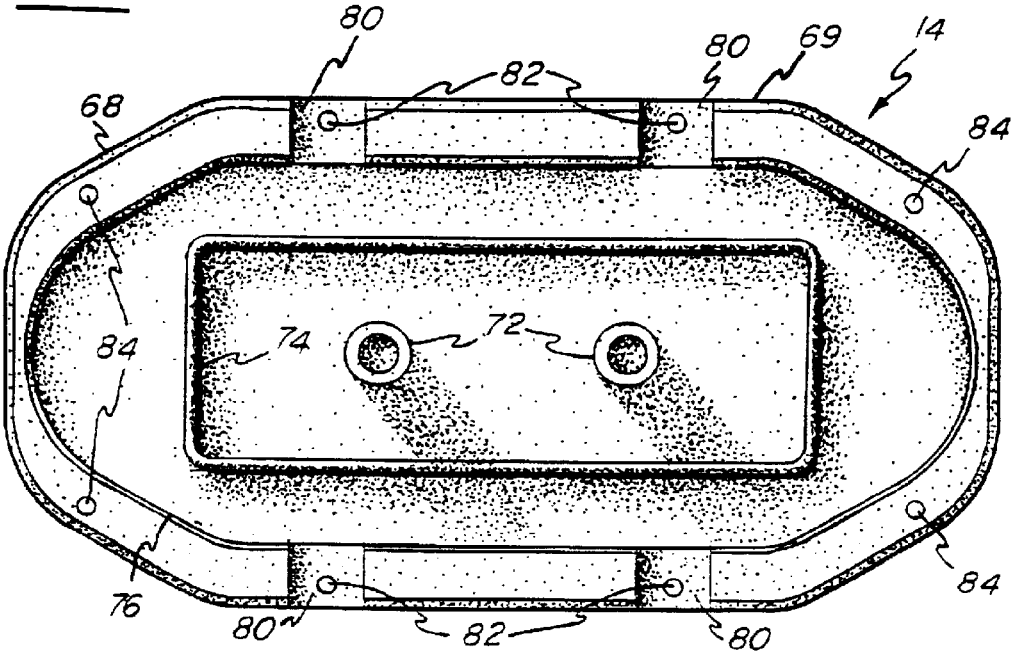
FIG. 7 is a bottom plan view of the cover of FIG. 1.

Referring now to FIGS. 1, 2 and 7, the cover 14 of the anchor positioning assembly 10 includes a top plate 68 having a peripheral edge 69 (FIG. 7) and a substantially planar upper surface 70 to facilitate flush contact with the concrete formwork 22. A pair of cylindrical pegs 72 extend downwardly from the top plate 68 and are slidably engageable with the receiving bores 52 of the void former 12. As may be appreciated, the positioning of the cylindrical pegs 72 within the receiving bores 52 inhibits relative pivoting movement of the first and second portions 26 and 28 of the void former 12 about the hinge webs 30.

A locating wall 74 disposed in a rectangular configuration extends downwardly from the top plate 68. The locating wall 74 is slidably receivable within the locating recess 58 of the void former 12 and facilitates proper final alignment of the cover 14 relative to the void former 12.

Figure 8:
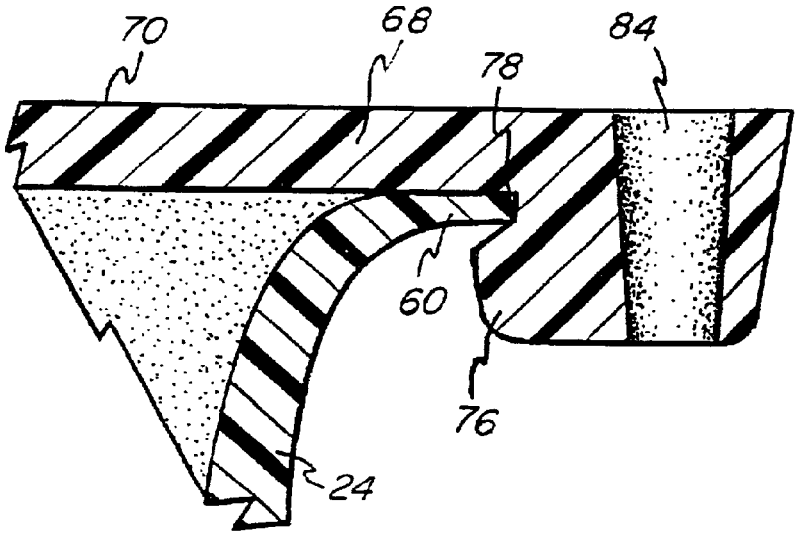
FIG. 8 is a detail view of FIG. 2.

Turning now to FIGS. 2, 7 and 8, a second locking member preferably includes a reentrant edge 76 extending proximate a substantial portion of the peripheral edge 69 of the cover 14 below the top plate 68. The reentrant edge 76 defines a locking groove 78 for releasably and lockingly engaging the peripheral lip 60 of the void former 12. Receipt of the peripheral lip 60 within the locking groove 78 enables the void former 12 to be snap locked into releasable engagement with the cover 14 (FIG. 8).

The locking groove 78 extends substantially continuously proximate the peripheral edge 69 of the cover 14 intermediate mounting recesses 80. Each mounting recess 80 of the cover 14 is aligned with a corresponding mounting tab 62 of the void former 12. The mounting recesses 80 include apertures 82 coaxially aligned with the apertures 64 of the mounting tabs 62. As such, a single fastener, preferably a nail 66, may pass through both the void former 12 and cover 14 for jointly securing both to the formwork 22. A plurality of additional mounting apertures 84 are provided around the periphery of the cover 14 for independently mounting the cover 14 to the formwork 22. It should be appreciated that the cover 14 may be mounted initially to the formwork 22 wherein the void former 12 is then simply snapped into engagement with the cover 14 by receipt of the peripheral lip 60 within the locking groove 78.

Both the void former 12 and cover 14 are preferably molded from a thermoplastic material. While it is preferred that high density polyethelene plastic be utilized, it should be appreciated that similar materials may be readily substituted therefor. A plurality of grooves or slots 85 are provided within the securing lugs 44 to reduce deformity of the void former 12 due to shrinkage of the thermoplastic material during the cooling process (FIG. 5).

The anchor 16 is of conventional design and preferably comprises an elongated steel member having opposing upper and lower ends 86 and 88. A pair of recessed portions are preferably disposed on opposite sides of the anchor 16. The recessed portions are preferably connected, thereby defining a through aperture 92. As illustrated in FIGS. 1 and 5, the upper end 86 of the anchor 16 may have a pair of downwardly extending inclined surfaces 94 connected by a flat end surface 96. Alternatively, as illustrated in FIG. 6, a further embodiment of the anchor 16' may include a pair of upwardly extending tabs 98.

Regardless of the particular shape and size of the anchor 16 positioned within the anchor placement channel 40, the securing lugs 44 of the void former 12 are releasably received within the aperture 92. The lugs 44 thereby serve to secure the anchor 16 within the anchor placement channel 40 such that the anchor 16 is in the desired position within the formwork 22 until the concrete has hardened.

Figure 9:
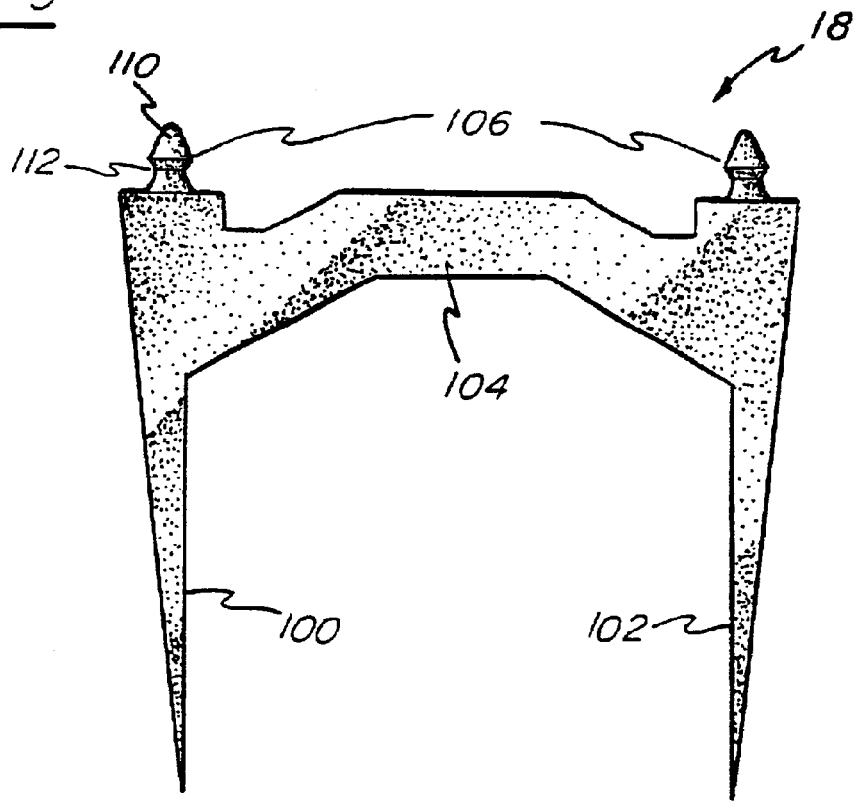
FIG. 9 is a front elevational view of the adaptor insert of FIG. 1.

Referring now to FIGS. 5 and 9, the adaptor insert 18 may be releaseably secured within the anchor placement channel 40 for facilitating the proper positioning of anchors 16 of variable shapes and sizes within the void former 12. The adaptor insert 18 is substantially U-shaped and includes first and second legs 100 and 102 connected by a bridge 104. A first securing member includes a pair of pegs 106 extending upwardly from the bridge 104 proximate the upper end of the first and second legs 100 and 102. A second securing member includes the apertures 48 of the hinge webs 30 proximate the upper end 108 of the anchor placement channel 40 for releasably securing the pair of pegs 106. Moreover, each peg 106 has a tapered point 110 positioned above an area 112 of reduced diameter. As the pegs 106 are pushed within the apertures 48, the tapered point 110 passes an area of reduced diameter 114 within the aperture 48 such that the tapered point 110 essentially locks the pegs 106 in position. The adaptor insert 18 is molded from a resilient thermoplastic material such that insertion and removal of the pegs 106 from the apertures 48 results in selective locking engagement between the void former 12 and adaptor insert 18.

In use, as illustrated in FIG. 1, the adapter insert 18, if needed, is inserted within the anchor placement channel 40 of the void former 12. More particularly, the first and second portions 26 and 28 of the void former are pivoted about the hinge webs 30 such that the inwardly facing channel walls 42 move away from each other such that the anchor placement channel 40 is enlarged. Pivoting movement of the first and second portions 26 and 28 may be facilitated by the insertion of dowel rods into the receiving bores 52 of the void former 12. The adaptor insert 18 may then be moved upwardly into the channel 40 such that the pegs 106 are releasably secured within the apertures 48 of the hinge webs 30.

As noted above, not all anchors 16' require the use of the adapter insert 18. Therefore the above steps may be eliminated for certain uses of the anchor positioning asesembly 10 (FIG. 6). Next, the anchor 16 is positioned within the anchor placement channel 40. This step involves pivoting the first and second portions 26 and 28 of the void former 12 about the hinge webs 30 such that the inwardly facing walls 42 and securing lugs 44 move away from each other. The anchor 16 is then aligned along the center plane 32 and moved up into the anchor placement channel 40 such that the aperture 86 of the anchor 16 is aligned with the securing lugs 44.

At this point, the first and second portions 26 and 28 may be pivoted such that the securing lugs 44 move toward each other and are received within the aperture 86 of the anchor 16. As such, the securing lugs 44 lock the anchor 16 into position. The void former 12, secured anchor 16, and insert 18, if needed, define a void former subassembly 116 which may then be set aside for final assembly as detailed below.

Independent of the construction of the void former subassembly 116, the cover 14 is attached to the formwork 22. More particularly, the upper surface 70 of the top plate 68 is positioned flush with the formwork 22. Next, nails 66, or other fasteners, are passed through the mounting aperture 84 in the top plate 68 and into the formwork 22 thereby fixing the cover 14 to the formwork 22.

After the cover 14 has been fixed in a desired location on the formwork 22, the void former 12 is simply snap locked into releasable engagement with the cover 14. More particularly, the receiving bores 52 of the void former 12 are aligned with the cylindrical pegs 72 of the cover 14 such that the pegs 72 are slidably received within the bores 52. Likewise, the locating recess 58 is aligned with the locating wall 78 of the cover 14. The void former 12 is then pushed toward the cover 14 such that the peripheral lip 60 of the void former passes over the reentrant edge 76 of the cover and into locking engagement with the locking groove 78.

Next, nails 66 or similar fasteners may be passed through the aperture 64 and 82 of the mounting tabs 62 of the void former 12 and mounting blocks 80 of the cover 14 and into engagement with the form work 22. As such, both the void former 12 and cover 14 are securely fastened to the formwork 22. Contact between the peripheral lip 60 and locking groove 78, along with contact between the mounting tabs 62 and mounting recesses 80, of the void former 12 and cover 14 respectively, provides a seal between the void former 12 and the cover 14 thereby preventing the leakage of concrete into the interior voids 50 of the void former 12.

After the anchor positioning assembly 10 is properly fixed to the formwork 22, wet concrete is poured into a mold defined by the formwork 22. The wet concrete subsequently surrounds the arcuate lower surface 38 and side walls 34 of the void former 12 and the anchor 16 and then subsequently hardens. The formwork 22 is thereafter removed. The cover 14 is disengaged from the void former 12 by passing the reentrant edge 76 over the peripheral lip 60. Next, the first and second portions 26 and 28 of the void former 12 are pivoted about the hinge webs 30 such that the inwardly facing channel walls 42 move away from each other and the securing lugs 44 move out of the aperture 92 of the anchor 16.

The arcuate lower surface 38 permits pivoting movement of the body portions 26 and 28 within the newly formed concrete panel 20. After the anchor receiving channel 40 is enlarged, the void former 12 may be pulled upwardly out of engagement with the anchor 16. The anchor 16 remains fixed within the newly hardened concrete panel 20 with its upper end 86 exposed in a newly formed recess. The upper end 86 or the anchor 16 provides a lifting point for subsequent manipulation and movement of the concrete panel 20.

While the forms of apparatus herein described constitute preferred embodiment of this invention, it is to be understood that the invention is not limited to these precise forms of apparatus, and that changes may be made therein without departing from the scope of the invention which is defined in the appended claims.

What is claimed is:

1. An anchor positioning assembly for forming a recess around the upper end of an anchor positioned in a concrete element, said anchor positioning assembly comprising:

a void former including a peripheral edge at one end thereof and defining an anchor placement channel adapted to receive one end of the anchor for forming the recess in the concrete element which exposes the one end of the anchor, said void former including first and second portions each having opposing side walls, an arcuate end wall connecting said opposing side walls, and a substantially open chamber defined by said opposing side walls and said arcuate end wall, said void former further including a hinge web pivotally connecting said first and second portions; and a cover including a top plate releasably engageable with said void former and having a peripheral edge which extends beyond the entire peripheral edge of said void former.

2. The anchor positioning assembly of claim 1, wherein the peripheral edge of said void former is defined by said opposing side walls and said arcuate end walls of said first and second portions.

3. The anchor positioning assembly of claim 2, wherein said void former further includes an upper surface and an arcuate lower surface defined by said arcuate end walls of said first and second portions.

4. The anchor positioning assembly of claim 3, wherein said anchor placement channel extends upwardly from said lower surface and is disposed immediate said first and second portions.

5. The anchor positioning assembly of claim 4, wherein said first and second portions of said void former include inwardly facing walls defining said anchor placement channel, said inwardly facing walls including opposed securing lugs for receipt within recesses formed within the one end of the anchor.

6. The anchor positioning assembly of claim 5, wherein:

each of said first and second portions of said void former includes a cylindrical rib extending upwardly from said end wall within one of said chambers and defining a receiving bore; and said cover includes a pair of cylindrical pegs, each of said cylindrical pegs slidably receivable within one of said receiving bores of said void former.

7. The anchor of positioning assembly of claim 6, wherein each of said first and second portions of said void former further includes a plurality of strengthening ribs interconnecting one of said cylindrical ribs and one of said opposing side walls and said end wall.

8. The anchor positioning assembly of claim 7, wherein said void former further includes a plurality of mounting tabs having apertures, said mounting tabs supported by said opposing side walls and extending outwardly from said side walls adjacent said peripheral edge.

9. An anchor positioning assembly for forming a recess around the upper end of an anchor positioned in a concrete element, said anchor positioning assembly comprising:

a void former having a pair of inwardly facing walls defining an anchor placement channel therebetween adapted to receive one end of the anchor for forming the recess in the concrete element which exposes the one end of the anchor;

a cover including a top plate releasably engageable with said void former; and an adaptor insert releasably securable within said anchor positioning channel and including first and second legs disposed transverse to said inwardly facing walls, a bridge connecting said first and second legs, and an inner surface adapted to conform substantially to the one end of the anchor.

10. The anchor positioning assembly of claim 9, further comprising a releasable securing device including a first securing member supported by said adaptor insert and a second securing member supported by said void former.

11. The anchor positioning assembly of claim 10, wherein said first securing member includes one of a peg in an aperture, said second securing member includes the other of said aperture and said peg.

* * * * *